US010066355B2

(12) United States Patent
Sim et al.

(10) Patent No.: US 10,066,355 B2
(45) Date of Patent: Sep. 4, 2018

(54) DEVICE FOR OBTAINING C.G.S INJECTION CONTROL CHART FOR SEISMIC RETROFITTING AND CONTROLLING QUALITY

(71) Applicants: Doo Sub Sim, Chungcheongnam-do (KR); Ji Hyun Park, Chungcheongnam-do (KR)

(72) Inventors: Doo Sub Sim, Chungcheongnam-do (KR); Ji Hyun Park, Chungcheongnam-do (KR)

(73) Assignees: XENON GROUND TECHNOLOGY CORP., Chungcheongnam-do (KR); DENVER KOREA E&C CO., LTD., Seongnam-si, Gyeonggi-do (KR)

( * ) Notice: Subject to any disclaimer, the term of this patent is extended or adjusted under 35 U.S.C. 154(b) by 0 days.

(21) Appl. No.: 15/329,056

(22) PCT Filed: Aug. 4, 2015

(86) PCT No.: PCT/KR2015/008139
§ 371 (c)(1),
(2) Date: Jan. 25, 2017

(87) PCT Pub. No.: WO2016/021913
PCT Pub. Date: Feb. 11, 2016

(65) Prior Publication Data

US 2017/0211252 A1 Jul. 27, 2017

(30) Foreign Application Priority Data

Aug. 5, 2014 (KR) ..... 10-2014-0100399

(51) Int. Cl.
*E02D 3/12* (2006.01)
*E02D 5/38* (2006.01)
*E02D 5/80* (2006.01)

(52) U.S. Cl.
CPC ..... *E02D 3/12* (2013.01); *E02D 5/38* (2013.01); *E02D 5/80* (2013.01);
(Continued)

(58) Field of Classification Search
CPC ..... E02D 3/12; E02D 2250/003
See application file for complete search history.

(56) References Cited

U.S. PATENT DOCUMENTS 4,514,112 A 4/1985 Sano et al.
5,197,828 A * 3/1993 Nakanishi ..... E02D 3/12 405/263

(Continued)

FOREIGN PATENT DOCUMENTS

JP 2000319866 A 11/2000
KR 100737833 B1 7/2007

(Continued)

OTHER PUBLICATIONS

Int'l Search Report dated Nov. 19, 2015 in Int'l Application No. PCT/KR2015/008139.

(Continued)

*Primary Examiner* — Tara Leigh Mayo-Pinnock
(74) *Attorney, Agent, or Firm* — Panitch Schwarze Belisario & Nadel LLP

(57) ABSTRACT

A device for obtaining C.G.S injection control chart for seismic retrofitting and controlling quality includes a pump unit which injects a grout into the ground in predetermined quantities per unit time at an injection pressure that is a predetermined static pressure; a sensor unit which measures a discharge pressure which is a pressure at which the grout injected into the ground through the pump unit is discharged from the pump unit; and a monitoring unit which calculates injection control charts for each depth on the basis of injection quantities per unit time of the grout being supplied (Continued)

by the pump unit, and the discharge pressure measured by the sensor unit.

4 Claims, 7 Drawing Sheets

(52) U.S. Cl.
CPC ..... *E02D 2250/003* (2013.01); *E02D 2250/0007* (2013.01); *E02D 2300/0021* (2013.01)

(56) References Cited

U.S. PATENT DOCUMENTS 5,234,289 A * 8/1993 Nakanishi ..... E02D 3/12 405/266
6,801,814 B1 * 10/2004 Wilson ..... E02D 3/12 175/71
2004/0165959 A1 * 8/2004 Shimada ..... E02D 3/12 405/266
2007/0014640 A1 1/2007 Kauschinger
2009/0304457 A1 * 12/2009 Shimada ..... C09K 17/06 405/269
2010/0135731 A1 * 6/2010 Barron ..... E02D 3/12 405/263

FOREIGN PATENT DOCUMENTS

KR 100907923 B1 7/2009
KR 101282184 B1 7/2013
KR 20140014552 A 2/2014

OTHER PUBLICATIONS

Office Action dated Jun. 22, 2017 in U.S. Appl. No. 15/328,980 by SIM.

* cited by examiner

DEVICE FOR OBTAINING C.G.S INJECTION CONTROL CHART FOR SEISMIC RETROFITTING AND CONTROLLING QUALITY

CROSS-REFERENCE TO RELATED APPLICATION

This application is a Section 371 of International Application No. PCT/KR2015/008139, filed Aug. 4, 2015, which was published in the Korean language on Feb. 11, 2016, under International Publication No. WO 2016/021913 A1, and the disclosure of which is incorporated herein by reference.

TECHNICAL FIELD

The present invention relates to a Device for obtaining C.G.S injection control chart for seismic retrofitting and controlling quality, and more particularly, to a Device for obtaining C.G.S injection control chart for seismic retrofitting and controlling quality that can form a grout pillar of a uniform form in the interior of a ground of an environment in which it is difficult to insert a pile into the ground.

BACKGROUND ART

Generally, a construction method for inserting an iron pile or the like into the interior of the ground is used as a method for reinforcing a soft ground.

However, in some cases, it is not possible to use such a construction method depending on the condition of the ground or the situation of the construction site.

In such cases, it is possible to apply a ground improvement method for reinforcing the ground using a method for injecting a non-flowable mortar-type injection material into the ground and forming a pillar-shaped consolidated body to compress and reinforce the surrounding ground, and such a construction method is well known as a compaction grouting system (C.G.S) construction method.

Because such a C.G.S construction method uses a low flowable material having a slump value of 5 cm or less, the consolidated body can be formed, while the injection material relatively less leaves the planned location, and it is possible to perform a work even in a narrow location such as a periphery of an existing structure work or a basement.

In addition, it is also possible to perform the construction with non-vibration/non-noise and to apply in urban or dense housing areas, and the used injection material also has environment-friendly characteristics.

However, since the injection status of the injection material to be injected into the ground is not checked with naked eye when performing the C.G.S construction method, there are problems of difficulty in understanding of the injection current situation and providing measures of the ground condition.

Thus, even when a ground crushing phenomenon caused by the injection of the injection material occurs, its provision is difficult, and there is a problem of taking the post actions after the crushing phenomenon occurs.

In addition, because checking of the designed quantitative injection and the construction quality control are dependent on the operator's experience value, there is a problem of difficulty in solving the question of the construction completion.

DISCLOSURE

Technical Problem

An aspect of the present invention is to solve the problems described in the background, and provides a device for obtaining C.G.S injection control chart for seismic retrofitting and controlling quality that can form a grout pillar of a uniform form in the interior of a ground of an environment in which it is difficult to insert a pile into the ground.

The technical problems to be solved by the present invention are not limited to the aforementioned technical problems, and other technical problems that have not been mentioned will be able to be clearly understood to a person who has conventional knowledge in the technical field to which the present invention pertains from the following description.

Technical Solution

According to an aspect of the present invention, there is provided a device for obtaining C.G.S injection control chart for seismic retrofitting and controlling quality that includes a pump unit which injects a grout into the ground in predetermined quantities per unit time at an injection pressure that is a predetermined static pressure; a sensor unit which measures a discharge pressure which is a pressure at which the grout injected into the ground through the pump unit is discharged from the pump unit; and a monitoring unit which outputs injection control charts for each depth on the basis of injection quantities per unit time of the grout being supplied by the pump unit, and the discharge pressure measured by the sensor unit.

Here, the pump unit may include at least one of a speed module which adjusts the unit time for injecting the grout in predetermined quantities, and a pressure module which controls an injection pressure of the grout.

Further, the pump unit may include a control module which controls at least one or more of the unit time for injecting the grout in predetermined quantities and the injection pressure of the grout, when the variation amount for each depth in the injection control chart calculated in the monitoring unit is varied.

At this time, the control module may control the grout injection pressure to be lower than the predetermined static pressure when the value of the variation amount for each depth in the injection control chart increases.

Further, the control module may increase the unit time for injecting the grout in predetermined quantities, when the value of the variation amount for each depth in the injection control chart decreases.

Meanwhile, the monitoring unit may include an information providing module which provides a user with information on the injection control chart calculated by the monitoring unit for each injection depth at which the grout is injected.

Further, the monitoring unit may include an alarm module which notifies the user of the variation when the variation amount for each depth in the injection control chart is varied.

Advantageous Effects

With the device for obtaining C.G.S injection control chart for seismic retrofitting and controlling quality according to the present invention, it is possible to form a grout pillar of a uniform form inside the ground under an environment in which it is difficult to insert the pile into the interior of the ground.

Effect to the present invention is not limited to the mentioned effect the above, another effect not mentioned will be clearly understood from the scope of the claims to those skilled in the art.

BEST MODE

Figure 1:
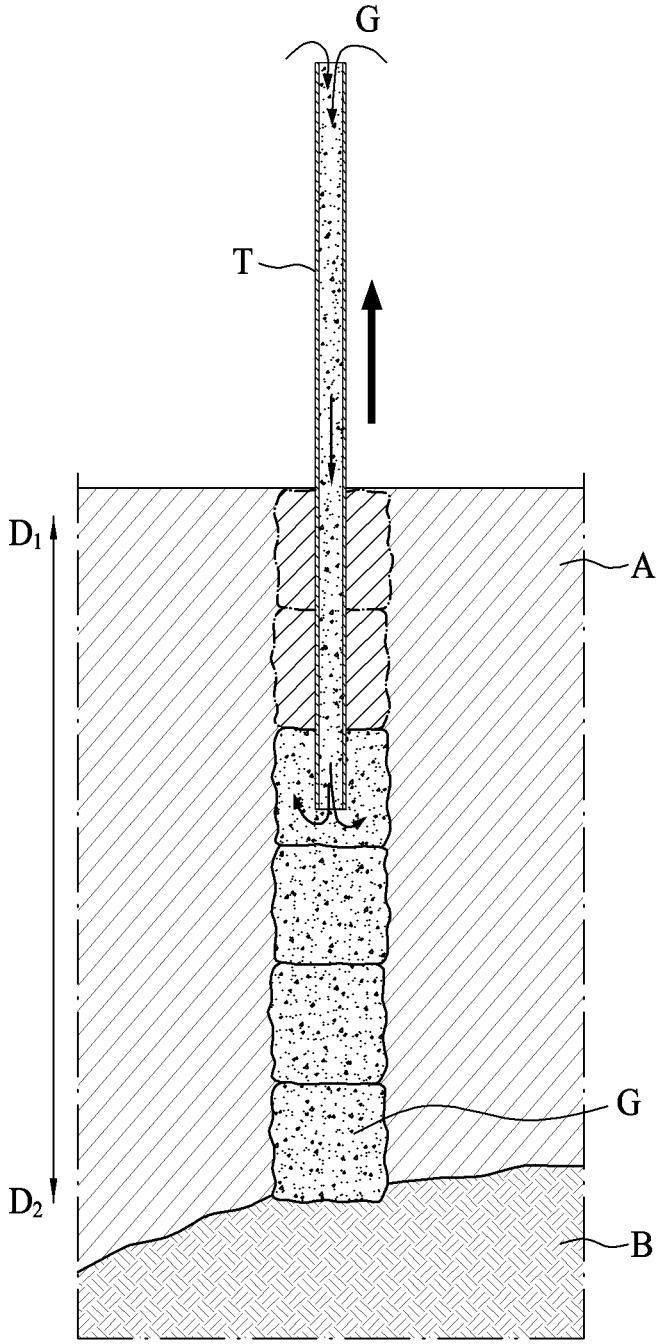
FIG. 1 is a diagram illustrating a status of forming a grout pillar inside a ground with uniform quality of soil using a C.G.S construction method.

Hereinafter, embodiments of the invention will be described in detail with reference to the accompanying drawings. The drawings are attached hereto to help explain exemplary embodiments of the invention, and the present invention is not limited to the drawings and embodiments. In the drawings, some elements may be exaggerated, reduced in size, or omitted for clarity or conciseness.

Hereinafter, an embodiment of the present invention will be described in detail with reference to the accompanying drawings. However, in describing the present invention, the description of functionalities or configurations that have been already known will be omitted for clarity of the subject matter of the present invention.

In addition, in describing the present invention, because the terms indicating the directions such as front/back or top/bottom are described so that those skilled in the art can clearly understand the present invention and indicate the relative directions, the scope of right is not limited thereby.

First, referring to FIGS. 1 through 4, the principle of forming the grout pillar by using the device for obtaining C.G.S injection control chart for seismic retrofitting and controlling quality according to the present invention will be described in detail.

Figure 2:
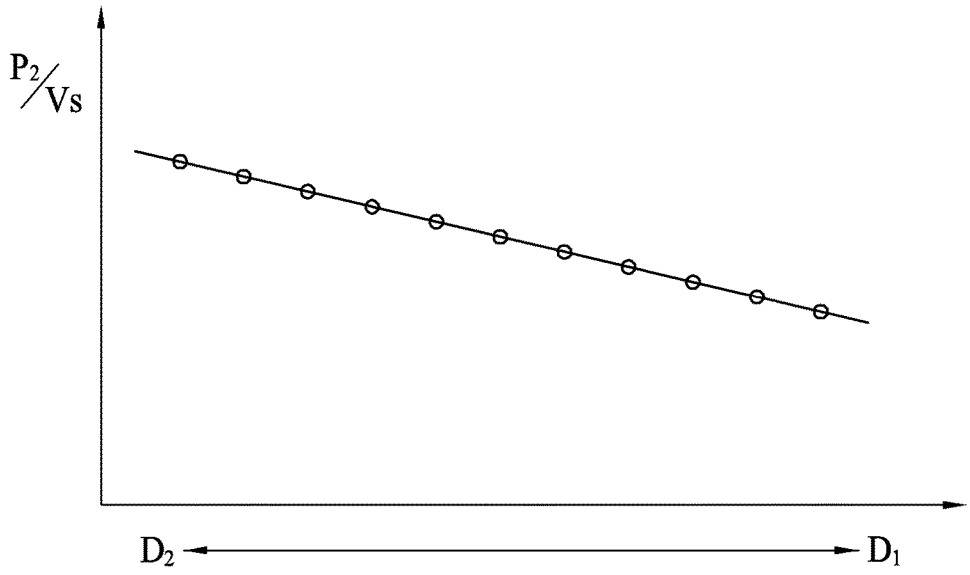
FIG. 2 is a graph illustrating a ratio of a grout discharge pressure per each depth and an injection quantity per unit time of the grout expressed in the case of FIG. 1.

Here, FIG. 1 is a diagram illustrating a status of forming a grout pillar inside a ground with uniform quality of soil using the C.G.S construction method. FIG. 2 is a graph illustrating a ratio of a grout discharge pressure per each depth and an injection quantity per unit time of the grout expressed in the case of FIG. 1.

Figure 3:
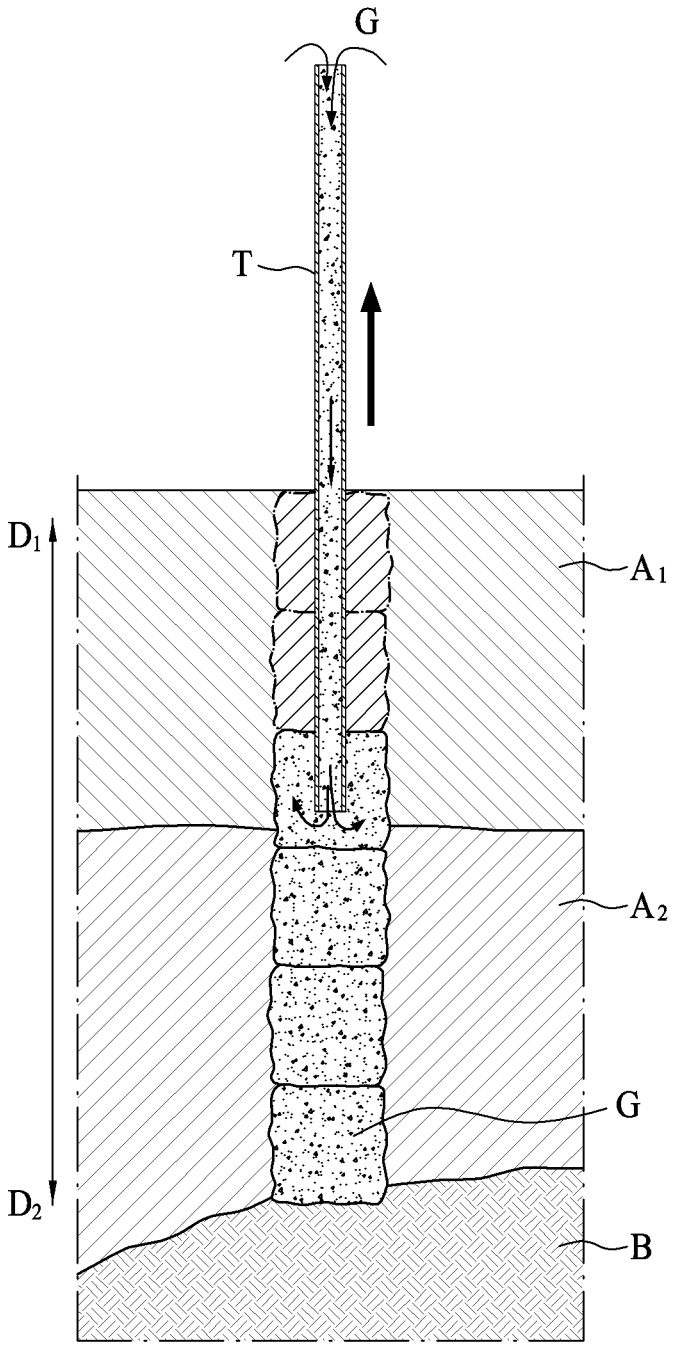
FIG. 3 is a diagram illustrating a status of forming a grout pillar in the ground with different upper and lower qualities of soil, using the C.G.S construction method.
Figure 4:
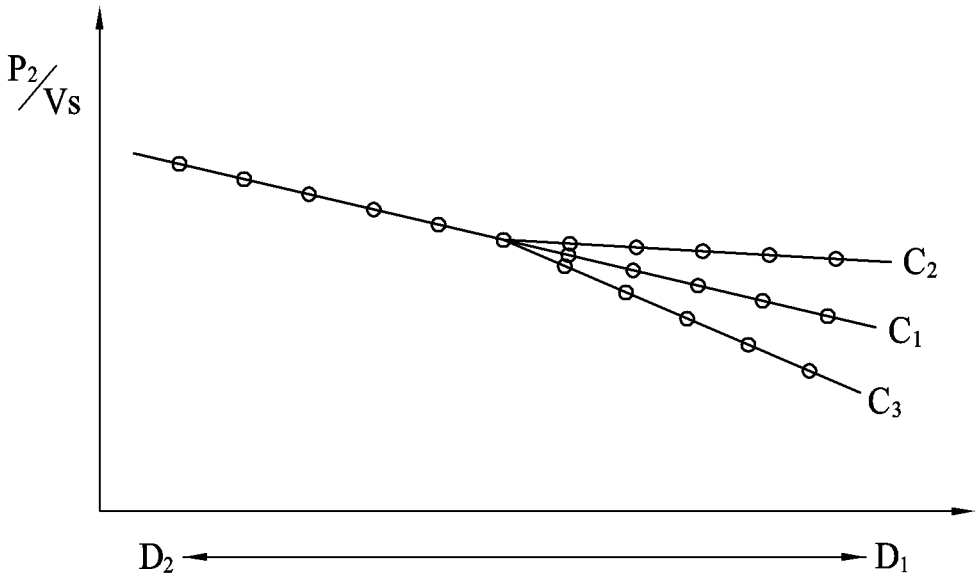
FIG. 4 is a graph illustrating the ratio of the grout discharge pressure per each depth and the injection quantity per unit time of the grout expressed in the case of FIG. 3.

Further, FIG. 3 is a diagram illustrating a status of forming a grout pillar in the ground with different upper and lower qualities of soil, using the C.G.S construction method. FIG. 4 is a graph illustrating the ratio of the grout discharge pressure per each depth and the injection quantity per unit time of the grout expressed in the case of FIG. 3.

As illustrated in FIG. 1, when forming the pillar in the interior of the ground using the C.G.S construction method, pillars formed by grouts G can be formed in the form of passing through a soft ground so as to be able to connect a rigid rock layer B and the ground to support a structure or the like.

In the general C.G.S construction method, the construction is performed through a method of injecting the grout G and moving the injection pipe T upward, after an injection pipe T for injecting the grout G to the interior of the ground is inserted to a deep depth D2 which reaches the rock layer B through the soft ground A. The C.G.S construction method capable of performing the seismic retrofitting and the quality control according to the present invention will also be described based on such a method.

First, when the grout G is injected to the interior of the ground, the predetermined quantity of grout G is injected at an injection pressure of a predetermined static pressure per unit time, and when a fixed amount of injection is completed, the injection pipe T can be raised at a predetermined interval and can be injected again.

At this time, if the quality of soil of the soft ground A, to which the grout G is injected, is uniformly formed from the deep depth D2 to a low depth D1, the grout G pillar of the similar amount and form is formed for each depth to which the grout G is injected, and the solidified grout G can serve as a pillar.

In such a case, in the course of performing the entire processes, the injection quantity per unit time of injection of the grout G can be the same.

Furthermore, although the injection pressure for injecting the grout G is also the same, the discharge pressure of the grout G discharged through the injection pipe T can be lowered in proportion to a distance at which the injection depth of the grout G is moved from the deep depth D2 to the low depth D1.

Accordingly, as illustrated in FIG. 2, when a value obtained by dividing the discharge pressure V2 of the grout G for each injection depth generated in the overall injection course by the injection quantity Vs of the grout G per unit time is expressed by a graph, it is possible to know that the variation amount is constant.

However, because a case where all the internal soil conditions of the ground are uniform is very rare, as illustrated in FIG. 3, the internal soil conditions of the ground can be partially different from each other.

FIG. 3 simply illustrates a case where the internal soil conditions of the ground are different from each other at the top and the bottom, and the principles of the present invention will be described on the basis of such a case.

In FIG. 3, when the upper layer A1 of the soft ground A is constituted by the ground formed to be denser than the lower layer A2, the grout G can be injected in the order of the lower layer A2 to the upper layer A1 of ground in the course of raising the injection pipe T, while injecting the grout G through the C.G.S construction method.

At this time, as described above, the discharge pressure of the grout G injected into the ground is lowered in proportion to a change in the injection depth. When injected to the upper layer A1 section that is relatively densely formed, the discharge pressure of the grout G can be lowered to a relatively small level.

That is, when the internal soil conditions of the ground becomes relatively dense during the injection process of the grout G, it is possible to measure the discharge pressure that is relatively higher than the discharge pressure of the grout G that can be expected when the internal soil conditions of the ground are uniform.

In such a case, because the density of the grout G itself becomes different for each injection depth in the pillar formed by injection of the grout G, it is not possible to appropriately support the force transmitted from the top of the ground, and a phenomenon of the ground being crushed by the pressure of the grout G in the construction process may also occur.

Meanwhile, as opposed to the aforementioned assumption, when the lower layer A2 of the soft ground A is constituted by a ground that is formed to be denser than the upper layer A1, it is also possible to inject the grout G in the order of the lower layer A2 to the upper layer A1 in the process of raising the injection pipe T, while injecting the grout G via the C.G.S construction method.

At this time, the discharge pressure which is lowered in proportion to the change in the injection depth of the grout G can be relatively greatly lowered, while injecting to the upper layer A1 section that is relatively loosely formed.

That is, when the internal soil conditions of the ground become relatively loose during the injection process of the grout G, it is possible to measure the discharge pressure that is relatively lower than the discharge pressure which can be expected when the internal soil conditions of the ground are uniform.

In such a case, it is not possible to form a stable pillar form such as an overall shape of the grout G pillar formed to be broadened to one side while injecting the grout G, and thus, it may not be possible to properly support the force that is transmitted from the top of the ground.

As illustrated in FIG. 4, such a change can be seen through a graph illustrating the value obtained by dividing the discharge pressure V2 of the grout G for each injection depth generated in the course of the overall injection by the injection quantity Vs of the grout G per unit time.

The graph expressed when the internal soil conditions of the ground are generally uniform can expect a form of C1. However, when the soil conditions of the upper layer A1 become relatively dense in the course of injecting the grout G from the deep depth D2 to the low depth D1, it is possible to express a shape of a graph of C2, and when the soil conditions of the upper layer A1 become relatively loose, a shape of a graph C3 can be expressed.

Accordingly, it is possible to form the grout G pillar of more uniform and constant form by preventing the deformation of the form of the graph.

Figure 5:
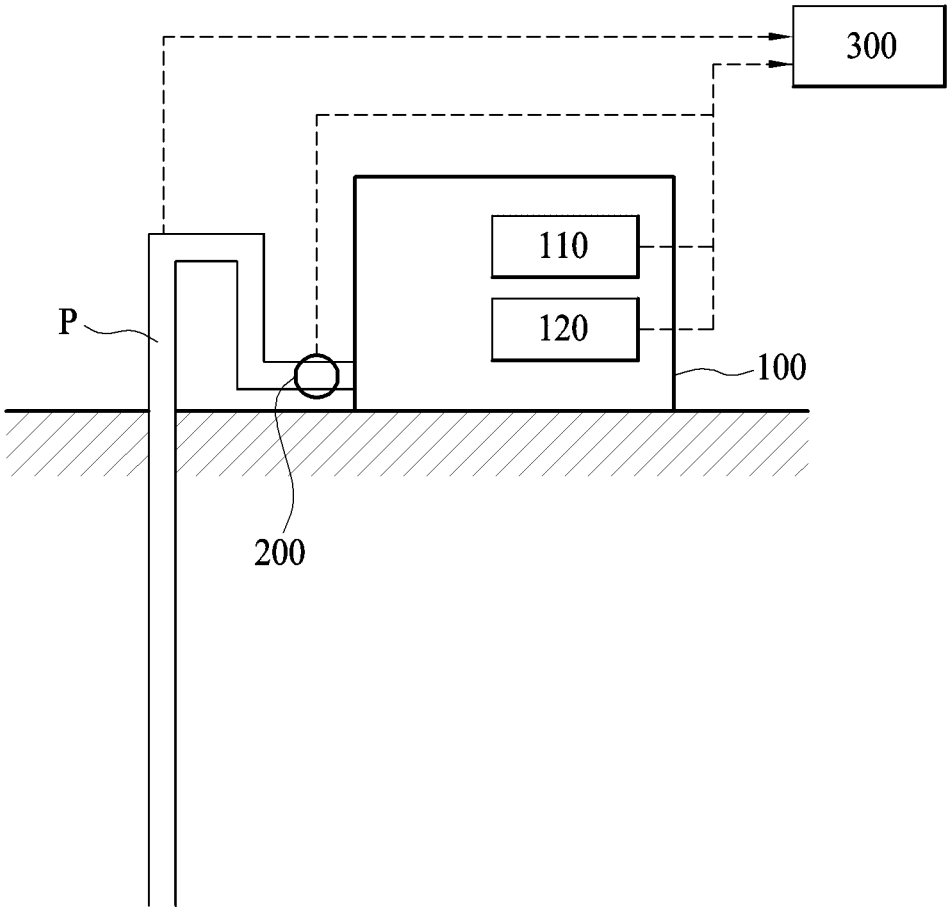
FIG. 5 is a diagram illustrating an overall configuration of the device for obtaining the C.G.S injection control chart for seismic retrofitting and controlling quality according to the present invention.
Figure 6:
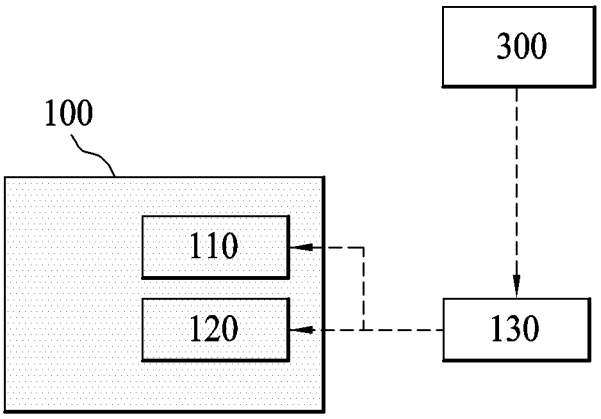
FIG. 6 is a diagram illustrating a configuration in which the pump unit of the device for obtaining C.G.S injection control chart for seismic retrofitting and controlling quality according to the present invention includes a speed module, a pressure module and a control module.
Figure 7:
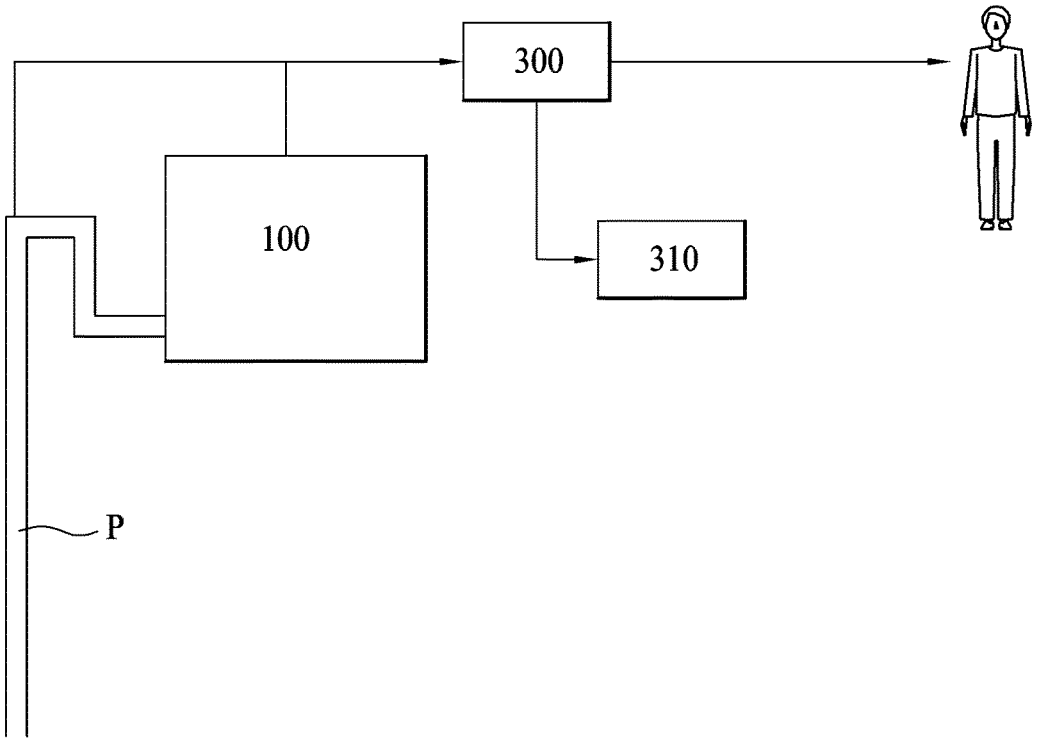
FIG. 7 is a diagram illustrating a status in which the monitoring unit of the device for obtaining C.G.S injection control chart for seismic retrofitting and controlling quality according to the present invention transmits the information to the user.

Next, a configuration of an embodiment of the device for obtaining the C.G.S injection control chart for seismic reinforcement and controlling quality according to the present invention capable of performing the process in accordance with the principles with reference to FIGS. 5 through 7 in detail.

Here, FIG. 5 is a diagram illustrating an overall configuration of the device for obtaining the C.G.S injection control chart for seismic retrofitting and controlling quality according to the present invention. FIG. 6 is a diagram illustrating a configuration in which the pump unit of the device for obtaining C.G.S injection control chart for seismic retrofitting and controlling quality according to the present invention further includes a speed module, a pressure module and a control module. FIG. 7 is a diagram illustrating a status in which the monitoring unit of the device for obtaining C.G.S injection control chart for seismic retrofitting and controlling quality according to the present invention transmits the information to the user.

First, as illustrated in FIG. 5, the device for obtaining C.G.S injection control chart for seismic reinforcement and controlling quality according to the present invention may include a pump unit 100, a sensor unit 200 and a monitoring unit 300.

The pump unit 100 is a component which injects the grout G into the interior of the ground, and is connected to supply the injection tube T to be able to supply the grout G inserted into the ground.

When such a pump unit 100 injects the grout G, the pump unit 100 is capable of injecting the grout G in predetermined quantities per unit time at an injection pressure that is a predetermined static pressure.

Here, the amount of injecting the grout G, per a predetermined unit time and the injection pressure of grout G may be set based on the soil permeability which is checked through sample of ground collected in the design step.

Meanwhile, the sensor unit 200 has a configuration which measures the grout being injected into the ground by the aforementioned pump unit 100 measures the discharge pressure which is the pressure discharged from the pump unit 100, and can be placed adjacent to the discharge port of the grout G of the pump unit 100.

The discharge pressure measured by the sensor unit 200 is transmitted to the monitoring unit 300 to be described later, and can be utilized to determine the injection status of the grout G.

Further, because the sensor unit 200 being provided adjacent to the discharge port is provided on the ground, it can be operated at a relatively stable environment. Accordingly, it is possible to improve the durability of the sensor unit 200 as compared to a case of measuring the discharge pressure of the grout G inside the ground, and its maintenance can be relatively easy.

A more detailed method of grasping the injection status of the grout G through the measured discharge pressure by using the device for obtaining the C.G.S injection control chart for seismic reinforcement and controlling quality according to the present invention will be described below.

Meanwhile, the monitoring unit 300 can calculate the injection control chart for each depth at which the grout G is injected, on the basis of the injection quantity per unit time of the grout G supplied by the pump unit 100 and the discharge pressure of the grout G measured by the sensor unit 200.

More particularly, as described above in the description of FIG. 4, the injection control chart calculated by the monitoring unit 300 may be a numerical value which is obtained by dividing the discharge pressure (V2), at which the grout G is discharged from the pump unit 100 for each depth, by an injection quantity (Vs) in which the grout G is injected per unit time.

The monitoring unit 300 can detect and determine whether the numerical value of the variation amount of the injection control chart for each depth varies, while checking the variation amount in which the numerical value of the injection control chart changes for each depth.

Moreover, when the numerical value of the variation amount of the injection control chart for each depth varies, it is also possible to take a subsequent action.

First, as described above, when the numerical value of the variation amount of the injection control chart for each depth is uniformly displayed, the grout G being injected into the ground can be formed of pillars of regular form.

Accordingly, if the numerical value of the variation amount of the injection control chart for each depth varies, it is possible to uniformly form the pillars of grout G by controlling the numerical value.

In a case where the injection control chart is a numerical value which is obtained by dividing the discharge pressure (V2), at which the grout G is discharged from the pump unit 100 for each depth, by the injection quantity (Vs) in which the grout G is injected per unit time, when the numerical value of the variation amount of the injection control chart becomes relatively larger, it is possible to lower the numerical value of the injection control chart by lowering the injection pressure of the grout G or by increasing the injection quantity (Vs) at which the grout G is injected per unit time.

Further, in contrast, when the numerical value of the variation value of the injection control chart becomes relatively smaller, it is possible to raise the numerical value of the injection control chart by raising the injection pressure of the grout G or by decreasing the injection quantity (Vs) at which the grout G is injected per unit time.

However, as compared to the case of raising the injection pressure or raising the injection quantity (Vs) of the grout G per unit time, when lowering the numerical value of the injection pressure or lowering the injection quantity (Vs) of the grout G per unit time, it is possible to reduce a load on the device for obtaining the C.G.S injection control chart for seismic retrofitting and quality according to the present invention, and it may be effective in energy saving.

Thus, it is possible to use a method for lowering the injection pressure of the grout G when the numerical value of the variation amount of the injection control chart becomes greater, and for setting the long unit time to reduce the injection quantity (Vs) at which the grout G is injected per unit time when the numerical value of the variation amount of the injection control chart becomes smaller.

To change the injection setting of the grout G, the pump unit 100 of the device for obtaining the C.G.S injection control chart for seismic retrofitting and controlling quality according to the present invention may include at least one of the speed module 110 and the pressure module 120.

The speed module 110 can control the unit time of injecting the grout G in predetermined quantities, and the pressure module 120 may be configured to control the injection pressure of the grout G.

The speed module 110 and the pressure module 120 may be driven by a construction operator, and may also be controlled automatically by the value of the calculated injection control chart.

First, when the speed module 110 and the pressure module 120 are automatically controlled by the value of the injection control chart calculated by the monitoring unit 300 as illustrated in FIG. 6, the pump unit 100 may further include a control module 130.

The control module 130 may keep a constant variation value of the overall injection control chart per each depth, by controlling the aforementioned speed module 110 or the pressure module 120 when the variation amount of the value varies, while checking the value of variation amount per each depth of the value of the injection control chart calculated by the monitoring unit 300.

In such a case, there may be an effect that is capable of saving the time and cost required for the overall process control.

Further, when the speed module 110 and the pressure module 120 are driven by the construction operator, it is necessary to transmit the numerical value of the injection control chart for each depth calculated in the monitoring unit 300 to the construction operator.

Thus, as illustrated in FIG. 7, the monitoring unit 300 may further include a separate information providing module 310 to transmit information on the injection control chart for each depth to the operator H.

In such a case, the information providing module 310 may be made up of a display to display the graph as in FIGS. 2 and 4.

The operator H may immediately cope with the problems that occur during the C.G.S process, by taking action for controlling the speed module 110 and the pressure module 120 of the pump unit 100 based on the information displayed on the information providing module 310.

Or, it is also possible to apply a configuration in which the monitoring unit 300 further includes a separate alarm module 320.

The alarm module 320 may alert the abnormality status to the operator H, when the variation amount value for each depth of the numerical value of the injection control chart calculated by the monitoring unit 300 varies.

In such a case, because the operator H directly changes the injection setting or the operator H can check whether there is a problem in the device for obtaining the C.G.S injection control chart for seismic retrofitting and controlling quality according to the present invention, there is an effect capable of immediately coping with such a problem.

Meanwhile, it is also possible to perform a combined control of an automatic operation mode and an operator operation mode in controlling the device for obtaining the C.G.S injection control chart for seismic retrofitting and controlling quality according to the present invention described above.

Through such a configuration, it is possible to obtain an effect that is capable of continuously controlling the injection status of the grout G, depending on the status of the ground during execution of the entire process of injecting grout G into the ground.

Thus, it is possible to obtain effects that can form a uniform grout G pillar regardless of the irregular change in soil layer and soil conditions difficult to be checked with the naked eye, and can provide the construction quality control and the ground crushing phenomenon prevention, by quickly coping with the problems that may arise during construction.

That is, it is possible to obtain an effect that is capable of controlling the injection of the grout G based on the data measured at the injection process of the grout G, without using the separate previous data obtained via a separate drilling or shooting etc. in order to grasp the internal status of the ground.

In addition, it is also possible to obtain effects that are capable of reducing the load on the device for injecting the grout G, saving the energy consumed for the injection of grout G, and reducing the time and cost required for the injection process of the grout G.

Further, although specific embodiments of the present invention have been described and illustrated as described above, it will be obvious to those skilled in the art that the present invention is not limited to the described embodiments and can be variously modified changed without de parting from the spirit and scope of the present invention. Accordingly, such modifications and variations should not be understood individually from the spirit and aspect of the present invention, and the modified examples fall within the scope of the following claims.

The invention claimed is:

1. A device for obtaining a compaction grouting system ("C.G.S") injection control chart for seismic retrofitting and controlling quality, the device comprising:

a pump unit injecting a grout into the ground with a constant quantity at an injection pressure of a predetermined constant pressure per unit time and including a control module controlling at least one of the unit time at which the grout is injected with a constant quantity and the injection pressure of the grout;

a sensor unit provided adjacent to a grout discharge port of the pump unit in order to measure discharge pressure which is a pressure at which the grout injected into the ground by the pump unit is discharged from the pump unit; and a monitoring unit calculating an injection management degree which is a value obtained by dividing the discharge pressure measured by the sensor unit by the injection quantity of the grout supplied by the pump unit per unit time for each injection depth of the grout and determining whether a numerical value of a variation amount of the injection management degree for each depth fluctuates, wherein the control module adjusts the injection pressure of the grout to be lower than the predetermined constant pressure when the variation amount value of the injection management degree calculated by the monitoring unit for each depth increases and increases the unit time at which the grout is injected with the constant quantity when the variation amount value of the injection management degree for each depth decreases.

2. The device of claim 1, wherein the pump unit comprises at least one of a speed module which adjusts the unit time for injecting the grout in predetermined quantities, and a pressure module which controls an injection pressure of the grout.

3. The device of claim 1, wherein the monitoring unit comprises an information providing module which provides a user with information on the injection control chart calculated by the monitoring unit for each injection depth at which the grout is injected.

4. The device of claim 1, wherein the monitoring unit comprises an alarm module which notifies the user of the variation when the variation amount for each depth in the injection control chart is varied.

* * * * *